US009260220B2

(12) United States Patent
Messerschmid et al.

(10) Patent No.: US 9,260,220 B2
(45) Date of Patent: Feb. 16, 2016

(54) CUP MADE OF A PAPER MATERIAL

(71) Applicants: Uwe Messerschmid, Albershausen (DE); Werner Stahlecker, Goeppingen (DE)

(72) Inventors: Uwe Messerschmid, Albershausen (DE); Werner Stahlecker, Goeppingen (DE)

(73) Assignee: PTM PACKAGING TOOLS MACHINERY PTE. LTD., Singapore (SG)

( * ) Notice: Subject to any disclaimer, the term of this patent is extended or adjusted under 35 U.S.C. 154(b) by 0 days.

(21) Appl. No.: 14/245,543

(22) Filed: Apr. 4, 2014

(65) Prior Publication Data

US 2014/0216972 A1 Aug. 7, 2014

Related U.S. Application Data

(63) Continuation of application No. 12/321,274, filed on Jan. 20, 2009, now Pat. No. 8,727,206.

(30) Foreign Application Priority Data

Jan. 21, 2008 (DE) ..... 10 2008 005 403

(51) Int. Cl.
*B65D 3/14* (2006.01)
*B65D 21/02* (2006.01)
(Continued)

(52) U.S. Cl.
CPC ..... *B65D 21/0233* (2013.01); *B31B 1/60* (2013.01); *B31B 17/00* (2013.01); *B31B 43/00* (2013.01);
(Continued)

(58) Field of Classification Search
CPC ... B65D 3/14; B65D 21/0233; B65D 81/3869
USPC ..... 229/5.5, 400, 403; 206/505, 515, 519, 206/520; 220/633, 635, 592.17, 592.2, 220/62.12, 62.18, 62.2; 215/10, 376, 377
See application file for complete search history.

(56) References Cited

U.S. PATENT DOCUMENTS 1,654,318 A 12/1927 Benson
1,968,270 A 7/1934 Thiebaut
(Continued)

FOREIGN PATENT DOCUMENTS

CH 563 889 A 7/1975
DE 961 053 3/1957
(Continued)

OTHER PUBLICATIONS

Eurasian Patent Office Search Report dated May 27, 2009 (4 pages).
(Continued)

*Primary Examiner* — Gary Elkins
(74) *Attorney, Agent, or Firm* — Flynn, Thiel, Boutell & Tanis, P.C.

(57) ABSTRACT

A cup made of paper material having a fillable interior is provided. The cup is formed by a conical sleeve and a bottom. The bottom is attached to the sleeve at the lower end of the interior with a bottom skirt in an essentially liquid-tight way. The sleeve and/or the bottom in the area of the bottom skirt and/or the bottom skirt itself includes, at least in one area along the periphery, an outwardly projecting widening. A lower edge of the widening forms a standing surface for the cup. The widening can form a structure for holding another cup of the same type, which structure can act together with a similar cup during stacking. The cup can include a heat-insulting outer sleeve.

8 Claims, 9 Drawing Sheets

(51) Int. Cl.

| | |
|---|---|
| ***B31B 1/60*** | (2006.01) |
| ***B31B 17/00*** | (2006.01) |
| ***B31B 43/00*** | (2006.01) |
| ***B65D 81/38*** | (2006.01) |

(52) U.S. Cl.

CPC ..... *B65D 3/14* (2013.01); *B65D 81/3869* (2013.01); *B31B 2201/226* (2013.01); *B31B 2201/60* (2013.01); *B31B 2217/062* (2013.01); *B31B 2217/082* (2013.01)

(56) References Cited

U.S. PATENT DOCUMENTS

| | | | | |
|---|---|---|---|---|
| 2,285,341 | A | 6/1942 | Lyon | |
| 2,416,381 | A | 2/1947 | Conti | |
| 2,563,352 | A | 8/1951 | Morse | |
| 2,563,362 | A | 8/1951 | Morse | |
| 2,816,697 | A | 12/1957 | Amberg | |
| 3,049,277 | A | 8/1962 | Shappell | |
| 3,139,213 | A | 6/1964 | Edwards | |
| 3,182,882 | A | 5/1965 | Aellen, Jr. et al. | |
| 3,186,850 | A | 6/1965 | Anthony | |
| 3,268,143 | A | 8/1966 | Bolcato | |
| 3,325,048 | A | 6/1967 | Bryant | |
| 3,372,830 | A | 3/1968 | Edwards | |
| 3,437,253 | A | 4/1969 | McDonald et al. | |
| 3,485,412 | A | 12/1969 | Hawley | |
| 3,499,569 | A | 3/1970 | Wentzel | |
| 3,526,316 | A | 9/1970 | Kalogris | |
| 3,529,743 | A | 9/1970 | Ehrbar et al. | |
| 3,568,878 | A | 3/1971 | Fotos | |
| 3,612,346 | A | 10/1971 | Schneider | |
| 3,854,583 | A | 12/1974 | Amberg et al. | |
| 3,949,927 | A | 4/1976 | Smith et al. | |
| 3,970,492 | A | 7/1976 | Amberg et al. | |
| 3,995,740 | A | 12/1976 | Amberg et al. | |
| 4,049,122 | A | 9/1977 | Maxwell | |
| 4,053,346 | A | 10/1977 | Amberg et al. | |
| 4,088,526 | A | 5/1978 | Amberg et al. | |
| 4,106,397 | A | 8/1978 | Amberg et al. | |
| 4,117,971 | A | 10/1978 | Itoh | |
| 4,197,948 | A | 4/1980 | Amberg et al. | |
| 4,836,400 | A | 6/1989 | Chaffey et al. | |
| 5,425,497 | A | 6/1995 | Sorensen | |
| 6,024,244 | A | 2/2000 | Hicks | |
| 6,213,301 | B1 | 4/2001 | Landis et al. | |
| 6,364,201 | B1 | 4/2002 | Varano | |
| 7,100,770 | B2 | 9/2006 | D'Amato | |
| 7,175,585 | B2 | 2/2007 | Okushita et al. | |
| 7,451,910 | B2 | 11/2008 | Frost et al. | |
| 7,481,356 | B2 | 1/2009 | Stahlecker | |
| 7,677,434 | B2 | 3/2010 | Fry | |
| 7,677,435 | B2 | 3/2010 | Stahlecker | |
| 7,905,821 | B2 | 3/2011 | Stahlecker | |
| 8,146,796 | B2 | 4/2012 | D'Amato | |
| 8,360,263 | B2 | 1/2013 | D'Amato | |
| 8,387,857 | B2 | 3/2013 | Messerschmid | |
| 8,727,206 | B2 * | 5/2014 | Messerschmid et al. | 229/403 |
| 8,740,055 | B2 | 6/2014 | Stahlecker | |
| 8,758,665 | B2 | 6/2014 | Riethmueller | |
| 2004/0065424 | A1 | 4/2004 | Mohan et al. | |
| 2004/0094612 | A1 | 5/2004 | D'Amato | |
| 2006/0118608 | A1 | 6/2006 | Stahlecker | |
| 2006/0226210 | A1 | 10/2006 | Stahlecker | |
| 2006/0237465 | A1 | 10/2006 | D'Amato | |
| 2007/0117702 | A1 | 5/2007 | Okushita et al. | |
| 2008/0023536 | A1 | 1/2008 | Frost et al. | |
| 2008/0023537 | A1 | 1/2008 | Frost et al. | |
| 2008/0029588 | A1 | 2/2008 | Messerschmid et al. | |
| 2009/0159653 | A1 | 6/2009 | Stahlecker | |

FOREIGN PATENT DOCUMENTS

| | | | | |
|---|---|---|---|---|
| DE | 1 904 088 | A | 9/1969 | |
| DE | 31 15 689 | A1 | 1/1982 | |
| DE | 297 06 961 | U1 | 9/1998 | |
| DE | 10 2005 017 741 | | 10/2006 | |
| DE | 102009044772 | A1 * | 6/2011 | B65D 21/0233 |
| EP | 1 227 042 | B1 | 7/2002 | |
| FR | 1 181 342 | | 6/1959 | |
| GB | 6984 | | 0/1913 | |
| GB | 393 640 | | 6/1933 | |
| GB | 558 436 | | 1/1944 | |
| GB | 832 407 | | 4/1960 | |
| GB | 1 261 531 | A | 1/1972 | |
| GB | 2 075 462 | A | 11/1981 | |
| GB | 2 420 267 | A | 5/2006 | |
| JP | 55-134046 | | 10/1980 | |
| JP | 59-35316 | | 3/1984 | |
| JP | 4-62609 | | 5/1992 | |
| JP | 08217051 | A | 8/1996 | |
| JP | 3058921 | | 6/1999 | |
| JP | 2001-002052 | | 1/2001 | |
| JP | 2001-192015 | A | 7/2001 | |
| JP | 2003 340943 | | 2/2003 | |
| JP | 2003-128038 | | 5/2003 | |
| JP | 2003-231191 | | 8/2003 | |
| JP | 2004-99079 | A | 4/2004 | |
| JP | 2005-153899 | | 6/2005 | |
| JP | 2006-143331 | | 6/2006 | |
| WO | WO 2008/009371 | A1 | 1/2008 | |
| WO | WO 2008/009372 | A1 | 1/2008 | |

OTHER PUBLICATIONS

German Patent Office Search Report dated Jun. 2, 2009 (7 pages).
Eurasian Patent Organization Examination Report dated Nov. 30, 2010 (1 page) with English translation thereof.
Examination Report issued in the Eurasian Patent Office for Application No. 200900031/31 dated Oct. 12, 2011 with English translation (3 pages).
Official Action in Japanese Patent Office issued in Application No. 2009-10385 dated Mar. 14, 2013 (5 pages).
English translation of Final Office Action of Japan Patent Office issued in Japan Application No. 2009-010385 dated Dec. 13, 2013 (4 pages).
Australian. Examination Report No. 1 issued in Australian Appln. No. 2008264158 dated Feb. 26, 2014 (4 pages).

* cited by examiner

CUP MADE OF A PAPER MATERIAL

CROSS REFERENCE TO RELATED APPLICATION

This is a continuation of prior U.S. application Ser. No. 12/321,274, filed Jan. 20, 2009, which issued as U.S. Pat. No. 8,727,206.

FIELD OF THE INVENTION

The present invention relates to a cup made of a paper material and having a fillable interior, which interior is formed by a conical sleeve and a bottom, whereby the bottom is attached with a bottom skirt to the sleeve in an essentially liquid-tight way at the lower end of the interior.

The present invention relates further to a process for producing a cup made of paper material, which consists of a conical sleeve and a bottom attached in the area of the lesser circumference of the sleeve by means of a bottom skirt.

BACKGROUND OF THE INVENTION

A cup of this kind is prior art in Japanese published patent application JP2001-192015A. The bottom skirt of the known cup widens out downwards. The widening serves to fix an outer sleeve, which surrounds the interior defining sleeve by forming a hollow space. As the widening of the bottom skirt defines the distance between the inner sleeve and the outer sleeve, the widening of the bottom skirt along the periphery must be continuous. The outer sleeve is placed around the bottom skirt, folded inwards and attached thereto. When the outer sleeve is being attached to the bottom skirt, it may occur that the liquid tightness of the bottom skirt is affected. The attaching of the outer sleeve by means of folding inwards is a very complicated process.

In the case of the known cup, the outer sleeve surrounds the bottom skirt completely, so that this can no longer be seen from the outside. When the outer sleeve is folded inwards and attached from the inside to the bottom skirt, counter-holding from the outside is no longer possible. The outer sleeve can only be pressed against from the inside with a very low level of force, which the bottom skirt can take up itself. If the pressure force is too great, the bottom skirt may tear; on the other hand, the attaching of the outer sleeve can be inadequate if the pressure force is too low. In the case of attaching the outer sleeve by means of heat sealing it can occur that the sealing between the bottom and the sleeve defining the interior dissolves, as when the inwardly folded outer sleeve is being sealed, no counter pressure can be exerted from the outside on the bottom skirt.

In the case of cups made of paper material, the bottom skirt is a very important element of the cup. The bottom skirt is necessary for the connection between the sleeve and the bottom. At least two material layers are disposed in thickness direction on top of one another, namely the material of the bottom and the material of the interior-defining sleeve. The bottom is advantageously pot-shaped, whose open side faces away from the filling opening of the cup. The at least two material layers are advantageously arranged along the wall of the pot-shaped bottom. It can be additionally provided that for example the sleeve is folded inwards around the material of the bottom, and that the bottom skirt consists of three or more material layers. The material of the bottom is glued or sealed to the material of the sleeve in the area of the bottom skirt, in order that it is liquid-tight for at least a certain time.

The term "paper material", from which the bottom and the sleeve are made, includes various materials, which comprise at least one layer of paper, paperboard or cardboard. In addition the material can comprise one or more layers made of synthetics and/or aluminium. It can also be provided that the paper material is waxed or coated, in order to provide a resistance against the liquid with which the cup is subsequently filled. The paper material is advantageously coated at least on the side facing the interior with a thin synthetic layer, preferably made of polyethylene. In contrast to purely synthetic material, the formability and in particular the degree to which such paper material is ductile is limited. In the case of too great a deformation, the paper material itself, or a provided coating, may tear, so that the liquid-tight properties are impaired. The bottom skirt is therefore an essential design feature in the case of cups made of paper material and cannot be omitted.

SUMMARY OF THE INVENTION

It is an object of the present invention to simplify the manufacturing process of a cup of the above mentioned type and to avoid difficulties with liquid-tightness at the bottom skirt.

This object has been achieved in accordance with the present invention in that the sleeve and/or the bottom in the area of the bottom skirt and/or the bottom skirt itself comprises at least in an area along the periphery an outwardly projecting widening, and in that a lower edge forms a standing surface for the cup.

The object has been achieved in accordance with the process according to the present invention in that the bottom is joined to the sleeve by the formation of a bottom skirt, whereby during the formation of the bottom skirt, the sleeve and/or the bottom in the area of the bottom skirt and/or the bottom skirt itself is widened outwards in at least one area along the circumference so that a lower edge of the widening forms a standing surface for the cup.

The standing surface of the cup is enlarged by means of the widening, even if the widening is only partial, so that the cup acquires an improved stability. The widening is hereby not covered, or not completely covered, by an outer sleeve, so that the material of the sleeve or the bottom directly forms the standing surface. The bottom skirt thus cannot be impaired in its liquid tightness by the application of additional material of the outer sleeve. In an advantageous embodiment, the widening is continuous and formed uniformly along the periphery. When the paper material is coated, it is advantageous to form the widening only to the point where the coating does not tear.

The bottom skirt is advantageously widened along its entire extent. The bottom skirt has then—as seen in axial section—an essentially constant angle of inclination in relation to the middle axis of the cup. In an embodiment it can be provided, however, that the bottom skirt has different height area, which have varying angles of inclination. The area of the bottom skirt bordering the bottom can hereby remain in its original form, while the lower edge of the bottom skirt is widened more and more. The top most height area can serve mainly to seal the fillable interior and joins the conical sleeve with the bottom in an essentially liquid-tight way. In this top most height area, the sleeve and the wall are sealed or glued together. At the lower height area of the bottom skirt, the material of the interior-defining sleeve and/or the wall of the bottom is widened and forms with its lower edge an enlarged standing surface for the cup. At this height area, a liquid-tight joining of the material of the bottom and the material of the sleeve is no longer absolutely necessary, so that sealing or gluing at the lower height area can at least to some extent be omitted.

The cup according to the present invention is very versatile, as it can be applied without an outer sleeve, or with a variety of different outer sleeves. A heat-insulating sleeve is advantageously provided, which surrounds the interior-defining sleeve while forming a hollow space. The outer sleeve is hereby advantageously slid onto the conical interior-defining sleeve along the middle axis and fixed, after the bottom skirt is formed and widened.

The widening on the bottom skirt can be applied very advantageously in order to improve the stacking properties of the cup. A stackable cup is for example known in European patent EP 1 227 042 B1. The interior-defining sleeve of the known cup comprises a first means for holding another cup of the same type. The known cup comprises a second holding means on an outer sleeve, which surrounds the interior-defining sleeve with a heat-insulating hollow space. The second holding means is formed by a curled part rolled inwards and applied to the lower end of the outer sleeve. When the cups are stacked, the second holding means applied to the outer sleeve can act together with a first holding means applied to a similar cup. A number of cups stacked on top of one another form hereby a stable stack, in which the stacked cups rest securely on top of one another, without however wedging in each other. As wedging of the stacked cups is prevented, the individual cups can therefore be very easily removed from the stack.

The known cup has the disadvantage in that the forces occurring in stacking are relayed through the interior-defining sleeve and through the outer sleeve. The forces, which must be relayed within the cup from the first holding means to the second holding means, are first transferred through the interior-defining sleeve to connecting points between the inner sleeve and the outer sleeve and relayed via these connecting points to the outer sleeve. In the outer sleeve the forces are relayed to the second holding means formed as an inwardly rolled edge and there transferred to the next cup. The inner sleeve and the outer sleeve must be sufficiently stable in order to take up the occurring forces. In addition, the connecting points between the outer sleeve and the inner sleeve must be designed to take up the maximum occurring forces.

The scope of the design of the cup according to European patent EP 1 227 042 B1 is disadvantageously limited, as the second holding means applied to the outer sleeve must always be adapted to the dimensions of the first holding means of another cup of the same type, and also to the relayed forces. It is not possible to provide the outer sleeve with an optional form, or to alter its form as required. It is also not possible to omit the outer sleeve in case of need without losing the good stacking properties.

In the cup according to the present invention it is provided that a means for holding another cup of the same type is arranged on the bottom skirt, which means can act together with a similar cup when the cup is stacked. The holding means is advantageously formed by the widening. It is advantageously provided that a first holding means is arranged on the interior-defining sleeve, which first holding means can act together with a second holding means applied on the widening of a similar cup when the cup is stacked.

The stackable cup is advantageously produced in a process by means of the following procedural steps:

forming of at least one first means for holding another cup of the same type on the interior-defining sleeve;

forming of a second means for holding on the bottom skirt, which second holding means can act together with a first holding means applied to a similar cup when the cup is stacked.

The second holding means is hereby arranged on the interior-defining sleeve or on the bottom, or on a bottom skirt connecting the interior-defining sleeve with the bottom. In any case, the second holding means is applied to a component of the cup which is in contact with the Tillable interior.

The cup according to the present invention has the advantage in that, even without an outer sleeve, the cup can be reliably stacked in a stable manner without wedging and easily de-stacked again. If it is provided that the cup should be assigned a heat-insulating outer sleeve, this can be achieved to a great extent independently and free of the limitations of the cup in European patent EP 1 227 042 B1. The forces occurring during stacking are simply relayed within the interior-defining components from the first holding means to the second holding means. An outer sleeve is thus not absolutely necessary. If, however, an outer sleeve is to be provided, it is not loaded by the forces occurring during stacking. The bottom skirt, by means of which the interior-defining sleeve is connected to the bottom, is a very stable part of the cup and is very well suited to taking up the forces. The forces occurring during stacking are relayed essentially by the interior-defining sleeve from the first holding means to the second holding means, which second holding means can be formed by the widening of the bottom skirt. This permits the formation of a very stable stack comprising a large number of cups, which do not become wedged inside one another even when the stack is subjected to knocks or is for example placed abruptly on the ground. The bottom and the interior-defining sleeve are in any case strong enough to take up the forces occurring during stacking, as they also must take up the forces occurring during filling.

In order to prevent a number of cups wedging during stacking it is advantageous that the dimensions of the second holding means are adapted to the dimensions of the first means for holding another cup of the same type. The first means for holding another cup of the same type can hereby be optionally formed. It is, however, essential that a contour is formed which can take up forces acting in axial direction of the cup, that is, the forces which act between two cups during stacking. The first holding means is advantageously designed as a bead or a rib, which is at least formed in one area along the circumference of the interior-defining sleeve. The bead or rib can be designed continuously along the circumference or with interruptions.

If, in an embodiment of the present invention, it is provided that the cup comprises a heat-insulating outer sleeve, the design of the heat-insulating outer sleeve is hereby optional. The outer sleeve can for example be made of synthetic, paper or composite material. In order to improve the insulation effect, the outer sleeve can also be corrugated, fluted, embossed or comprise a foam layer. The outer sleeve can be designed as a multi-layered sleeve, for example a corrugated intermediary layer can be provided, which is then covered over by a smooth outer layer. As the cup according to the present invention can be stacked independently of the type of outer sleeve, one and the same inner cup can be combined in a simple and almost endless variety of ways with a variety of outer sleeves. Without changing the shape and dimensions of the inner cup or the components forming the fillable interior, a variety of cups having various optical and haptical designs can be created, owing to the fact that the appearance of the cup as seen by the consumer is mainly defined by the design of the outer sleeve.

In a process for manufacturing a double-walled cup, the following procedural steps are advantageously executed:

forming of at least one first means for holding another cup of the same type on the sleeve defining the interior;

forming of a widened bottom skirt and pressing of the interior-defining sleeve and the bottom;

forming of a second holding means at the bottom skirt, which second holding means can act together with a first holding means applied to a similar cup when the cup is stacked;

sliding on of a tube-shaped pre-formed outer sleeve over the interior-defining conical sleeve in axial direction;

fixing the outer sleeve to the interior-defining sleeve.

The fixing of the outer sleeve on the inner sleeve can take place for example by means of sealing or gluing. This effects a secure connection between the outer sleeve and the interior-defining sleeve, so that the outer sleeve is reliably prevented from slipping, even if the outer sleeve has only a low height.

In order to achieve a good appearance of the cup, it is advantageous that the outer sleeve ends below the first means for holding another cup of the same type, or even below the bottom. The first holding means applied to the inner sleeve is thus covered over by the outer sleeve and is no longer visible from the outside. Furthermore, it is advantageous when the outer sleeve ends above the widening of the bottom skirt.

The widening of the bottom skirt advantageously takes place by means of the dual action of a tool arranged outside and inside of the bottom skirt. Therefore, the widening can be formed very precisely.

The widening is advantageously spread outwards to such a degree that a parallel to the interior-defining sleeve disposed on the lower edge of the widening, extends at a certain distance outside of the interior-defining-sleeve. In order that a provided outer sleeve does not prevent the stacking of the cups, it is advantageous that the outer contours of the outer sleeve are located within the parallel to the interior-defining sleeve, which parallel is disposed on the widening of the bottom skirt.

BRIEF DESCRIPTION OF THE DRAWINGS

These and further objects, features and advantages of the present invention will become more readily apparent from the following detailed description thereof when taken in conjunction with the accompanying drawings. Individual features of the various embodiments shown and described can be combined optionally without exceeding the framework of the present invention.

DETAILED DESCRIPTION

Figure 1:
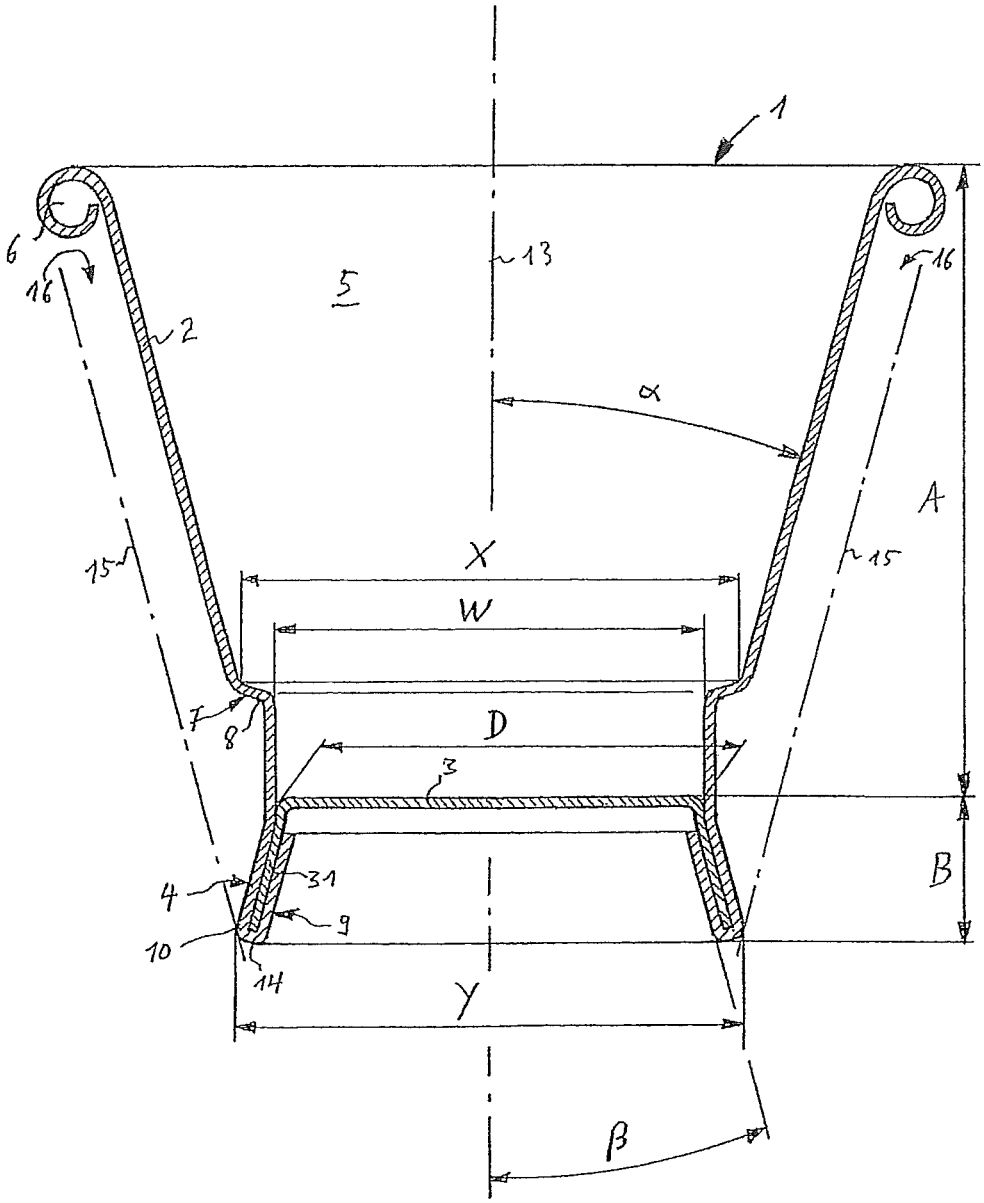
FIG. 1 shows a cup according to the present invention in longitudinal section.

The cup 1 shown in FIG. 1 consists essentially of a conical sleeve 2 and a pot-shaped bottom 3. The open side of the pot-shaped bottom 3 is arranged in such a way that it is facing away from the filling opening of the cup 1. The bottom 3 with its wall 31 is joined liquid-tight to the sleeve 2 in the area of its smallest diameter by means of the formation of a bottom skirt 4. In the area of the bottom skirt 4, the material of the sleeve 2 is placed around the wall 31 of the bottom 3 and folded inwards. The sleeve 2 and the bottom 3 form a fillable interior 5 of the cup 1. The fillable interior 5 has a height A. The sleeve 2 defining the interior 5 comprises on its top rim, that is, in the area of its largest circumference, an outwardly rolled lip 6, which surrounds the filling opening.

The conical feature of the sleeve 2 is hereby understood in that the sleeve 2 tapers in longitudinal section as shown in FIG. 1 from the lip 6 to the bottom 3 at least in certain areas. The sleeve 2 comprises hereby in the area of the fillable interior 5 above a bead 8 an angle of inclination $\alpha$ to the middle axis 13 of the cup 1. The sleeve 2 below the bead 8 has a cylindrical form reaching to the bottom 3. The form of the sleeve 2 in cross section is hereby irrelevant. The sleeve 2 is advantageously circular in cross section, but can alternatively be oval for example, or rectangular with rounded corners. The cup 1 has a truncated cone shape in the case of a round cross section of the conical sleeve 2, while in the case of a rectangular cross section of the cup, the conical sleeve 2 has more likely a truncated pyramid shape.

The bottom skirt 4 comprises at least in the area along its periphery an outwardly projecting widening 10. A widening should be understood in this present case in that the bottom skirt 4, in relation to a circular cylinder around the middle axis 13, flares outward, so that the bottom skirt encircles a cross section area which enlarges downwards towards the standing surface. A lower edge 14 of the widening 10 on the bottom skirt 4 forms the standing surface for the cup 1. The cup 1 stands, when in use, on its standing surface, which is enlarged by the widening 10. This makes it difficult for the cup 1 to tip over. The widening 10 is advantageously designed continuously around the circumference of the bottom skirt 4.

Figure 2:
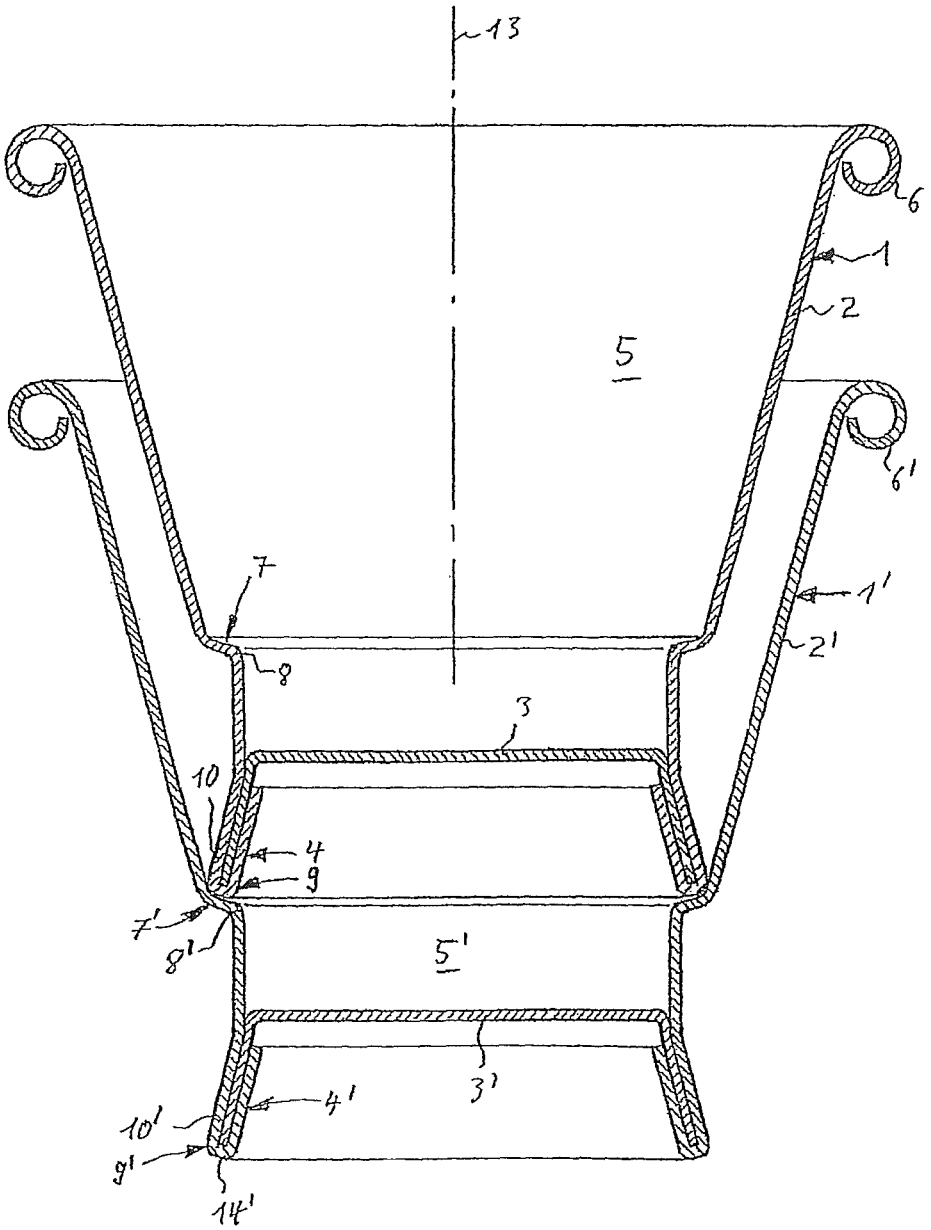
FIG. 2 shows a view similar to FIG. 1 of two stacked cups.

The outwardly projecting widening 10 also forms means 9 for holding another cup 1' of the same type, which means can act together with a similar cup 1' when the cup is stacked. The stacking of the cup 1 in a similar cup 1' is shown in FIG. 2. The widening 10, as a means 9 for stacking the cup 1, can hereby for example act together with a sleeve 2' defining the interior 5'. Further stacking means are not absolutely necessary.

The sleeve 2 defining the interior 5 advantageously comprises a first means 7 for holding another cup 1 of the same type, which means can be optionally formed. It is important that the first holding means 7 comprises a contour which can take up forces acting in the direction of the middle axis 13 of the cup 1, that is, forces which act between two cups during stacking. The first holding means 7 can be formed for example by means of a rib or a bead 8, which projects into the interior of the cup 1. The above mentioned second means 9 in the form of a widening 10 is arranged to the bottom skirt 4, at which the sleeve 2 defining the interior 5 is folded around the pot-shaped, deep drawn bottom 3 and fixed liquid-tight thereto.

The dimension Y of the second holding means 9 is adapted to the dimension X of the first means 7 for holding another cup 1' of the same type. In the case of a circular cross section of the cup 1, the dimension X of the first holding means 7 corresponds to the inner diameter of the sleeve 2 above the bead 8. The dimension Y of the second holding means 9 corresponds to the largest outer diameter of the widening 10 at the bottom skirt 4, that is, the diameter which the widening 10 encloses. The adaptation of the dimensions X and Y take place in that the dimension Y is somewhat smaller or at maximum is the same size as the dimension X.

The interaction of the first means 7 for holding and the second means 9 for holding is evident in the cups 1 and 1' shown in FIG. 2. The first means 7' of the cup 1' applied to the sleeve 2' defining the interior 5' takes up the second means 9 of the cup 1. The widening 10 applied to the bottom skirt 4 of the cup 1, and in particular the bottom end of the widening 10, that is approximately the standing surface at the lower edge 14, is supported hereby on the bead 8', which is formed into the sleeve 2'. Because of the above mentioned adaptation of the dimension X of the first holding means 7 to the dimension Y of the second holding means 9, it is ensured that the widening 10 of the cup 1 stands on the bead 8' in a secure and stable way, without however wedging itself in the conical sleeve 2'. The forces which occur along the middle axis 13 during stacking, for example the forces of weight of the cup 1 or of the cups stacked on top of it, are taken up reliably by the bead 8' as the holding means 7' and relayed via the sleeve 2' to the lower edge 14' of the bottom skirt 4' of the lower cup 1', and passed on to the ground from the lower edge 14' located at the standing surface. This ensures the easy removability of the cup 1 or 1' when the cups are de-stacked, even when very high forces in the direction of the middle axis 13 occur.

In order to achieve a sufficiently large widening 10 having a correspondingly large dimension Y without adversely affecting the liquid tightness of the sleeve 2, it is advantageous when the height of the widening 10—as can be seen in FIG. 1—extends essentially over the entire height B of the bottom skirt 4. As seen in axial section of FIG. 1, the bottom skirt 4 comprises a constant angle of inclination β in relation to the middle axis 13 of the cup 1. The angle of inclination β of the height area B of the bottom skirt 4 is aligned in any case in such a way that the bottom skirt 4 widens towards the lower edge 14 and has its widest dimension Y at its lower edge 14, that is, the lower edge 14 of the bottom skirt 4 forms the area of the bottom skirt 4 which is furthest from the middle axis 13 as seen parallel to the middle axis 13. In contrast to the angle of inclination α of the sleeve 2 in the area of the interior 5, the angle of inclination β is so aligned that the conicity extends in the opposite direction.

The diameter Y surrounding the widening 10 is hereby advantageously larger than the diameter D, which surrounds the area of the bottom 3, which is in contact with the interior 5. In order to permit effective stacking, and that the stacking height is not unnecessarily high, it is advantageous when the holding means 7 assigned to the sleeve 2 defining the interior 5 is not arranged higher above the bottom 3 than a third of the height A of the interior 5. Even if the means 7 is omitted, and the widening 10 is supported directly on the conical area of the sleeve 2, the diameter Y enclosing the widening 10 is advantageously smaller than a diameter enclosing the inner contour of the sleeve 2 at a height above the bottom 3 of approximately a third of the height A.

The rib or the bead 8 can be stamped or rolled by forming tools, which are placed to the sleeve 2 in axial or radial direction of the cup 1. The diameter W enclosing the first means 7 for holding another cup 1' of the same kind, that is the inner diameter W of the bead 8, is approximately as large as diameter D surrounding the area of the bottom 3 which comes into contact with the inner space 5. The sleeve 2 defining the interior 5 is as a result essentially cylindrical between the first holding means 7 and the bottom 3.

The widening 10 at the bottom skirt 4 can for example be formed by a cone-shaped mandrel, which is placed to the bottom skirt 4 from below. If required, the bottom skirt 4 can be heated for the purposes of forming the widening 10. Because a forming tool, which executes a sliding motion in relation to the surface of the bottom skirt 4, can very easily form creases, it can therefore also be advantageous to form the widening 10 by means of a rolling tool or by means of a tool which spreads out in radial direction. It can hereby be advantageous to assign to the outer circumference of the bottom skirt 4 a correspondingly formed counter tool, in order to support the formation of the widening 10. A particularly advantageous process for manufacturing the cup 1 is described in more details below with the aid of FIGS. 6 to 8.

FIG. 3 shows in the individual drawings A to C in schematic form various embodiments of the cup 1 in the area of the bottom skirt 4. In the variations in the remaining Figures, the bottom skirt 4 is always formed by three layers of material, namely by two layers of the sleeve 2, which surround the wall 31 of the pot-shaped bottom 3 on the inside and on the outside. This embodiment is often very advantageous, but is not absolutely necessary in order to realize the present invention. In the case of specified requirements, the following variations could also be advantageous.

Figure 3A:
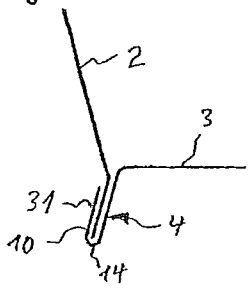
FIGS. 3A to 3C show, schematically and only partially, longitudinal sections of various embodiments in the area of the bottom skirt.

It is provided in FIG. 3A that the material of the bottom 3 is folded outwards and encloses the material of the sleeve 2. The lower rim 14 of the widening 10, which forms the standing surface for the cup 1, is hereby formed by the material of the bottom 3.

Figure 3B:
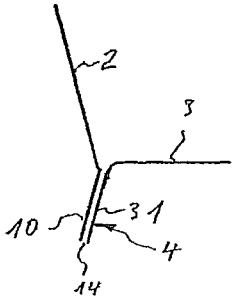

In FIG. 3B an embodiment is shown in which the bottom skirt 4 is formed by two material layers. The material of the sleeve 2 and the wall 31 of the bottom 3 end both at the lower rim 14 and thus form the standing surface.

Figure 3C:
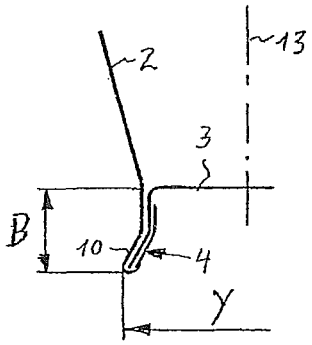

In FIG. 3C an embodiment of the bottom skirt 4 of the cup 1 is shown in which the bottom skirt 4 in its height area B has various angles of inclination in relation to the middle axis 13. Depending on the height B of the bottom skirt 4 and the desired dimension Y of the widening 10, it can be sufficient to provide only a part area within the height area B with a widening 10. The remaining area can, for example, be essentially cylindrical, so that the bottom skirt 4 extends there approximately parallel to the middle axis 13. For small widenings 10 it can be sufficient that the angle α of the sleeve 2 in the area of the interior 5 is continued unchanged in the upper area of the skirt by the sleeve 2.

Although not shown in FIGS. 1 to 3, it can be advantageous to assign the cup 1 an outer sleeve, which surrounds the sleeve 2 defining the interior 5 while forming a hollow space. In order that the stacking of the cup 1 is not impaired, it can be advantageous that the outer contour of the outer sleeve is located within a parallel 15 to the sleeve 2 defining the interior 5, whereby the parallel 15 is disposed on the widening 10 of the bottom skirt 4. As long as an outer sleeve is located within the space 16 between the parallel 15 and the sleeve 2 defining the interior 5, the stacking properties of the cup are not influenced in any way. The design possibilities are thus endless. It is also possible to equip a common embodiment of the cup 1 with variously designed outer sleeves, without having to change the first holding means 7 and the second holding means 9. Several possible embodiments for outer sleeves of this type are described below with the aid of FIGS. 4 and 5.

Figure 5:
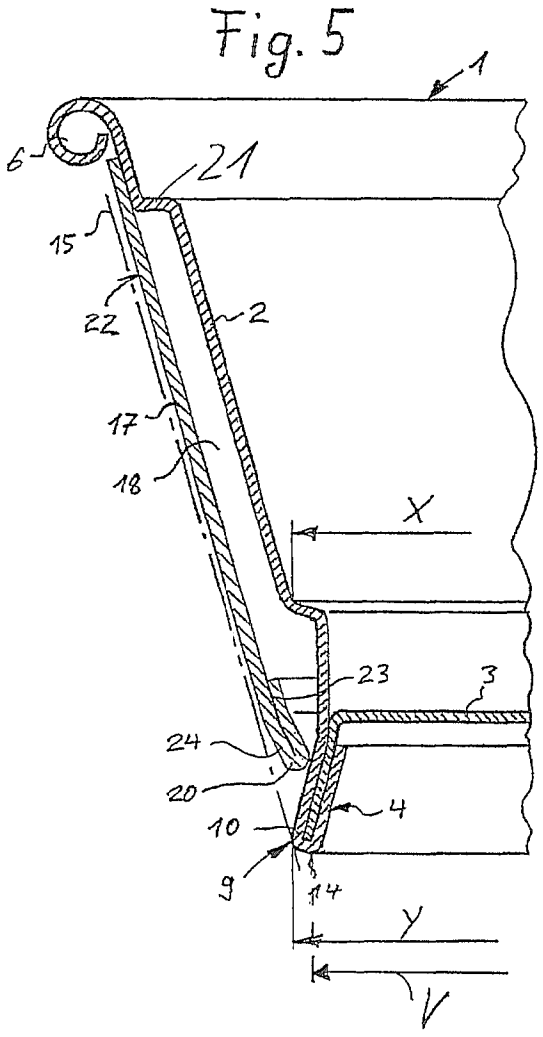
FIGS. 4 and 5 show views similar to FIG. 1 of partially depicted cups of various embodiments, in which various outer sleeves are provided.
Figure 4:
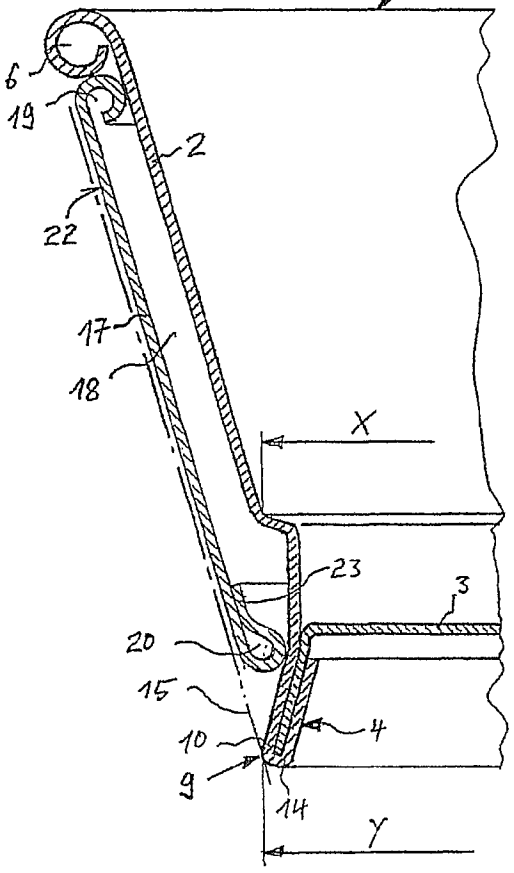

The cups 1 shown in FIGS. 4 and 5 each comprises a heat-insulating outer sleeve 17, which surrounds the sleeve 2 defining the interior 5 partly under formation of a hollow space 18. Cups of this type are defined as double-walled insulating cups, in which the sleeve 2, in conjunction with the bottom 3, located inside of the outer sleeve 17 can be defined as an "inner cup". The first means 7 for holding another cup 1' of the same type and the second holding means 9 are designed analogue to the embodiment described in FIG. 1, so that a repeat description can be omitted.

The outer sleeve 17 of the cup 1 shown in FIG. 4 is arranged essentially parallel to the sleeve 2 defining the interior 5. The outer sleeve 17 comprises on an upper and on a lower end inwardly rolled curled parts 19 and 20 and is supported by the curled parts 19 and 20 on the sleeve 2 defining the interior 5. It can be provided that the outer sleeve 17 is fixed in the area of the curled part 19 and/or 20, for example by means of gluing. The curled part 20 is supported on the inner sleeve 5 in the area of the bottom skirt 4, that is below the horizontal bottom 3, as a result of which the outer sleeve 17 is very stable. At the same time the outer sleeve 17 also covers the first holding means 7, so that this is not recognizable from the outside. The curled part 20 comprises an area 23 extending parallel to the outer sleeve 17. The area 23 extends in close proximity to the inner side of the outer sleeve 17 and may be disposed on said inner side. The sliding of the outer sleeve 17 onto the sleeve 2 is simplified as a result of the area 23 extending parallel to the outer sleeve 17, as the outer sleeve 17 can no longer get stuck on the bottom skirt 4.

In FIG. 5, the sleeve 2 defining the interior 5 comprises an abrupt change in size in the form of a shoulder 21 in the area below the lip 6, which shoulder 21 presents itself as an abrupt increase of the cross section when seen from the bottom 3 to the lip 6. The outer sleeve 17 is attached in the area between the lip 6 and the shoulder 21 to the sleeve 2 defining the interior 5, for example by means of sealing or gluing. At its lower end the outer sleeve 17 comprises an inwardly rolled curled part 20, which also comprises an area 23 extending parallel to the outer sleeve 17. The curled part 20 is supported below the bottom 3 on the bottom skirt 4. The curled part 20 is in contrast to FIG. 4, pressed flat and is slightly compressed at the lower edge area 24 of the outer sleeve 17, so that a greater conicity of the outer sleeve 17 is present in this area.

Figure 5A:
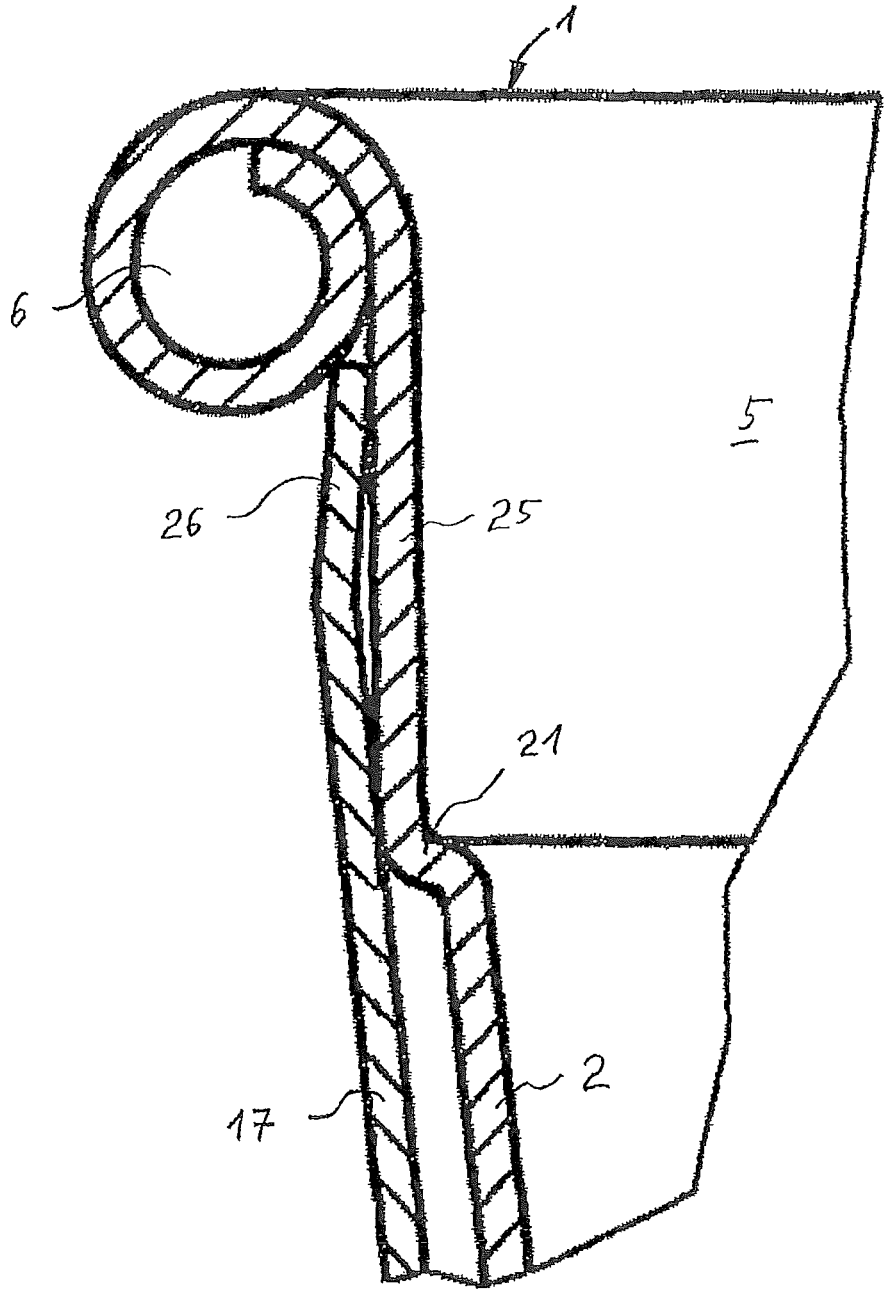
FIG. 5A is an enlarged view of a variation of FIG. 5.

In contrast to the depiction shown in FIG. 5, the cup 1 can be designed differently in the area of the shoulder 21. An advantageous variation in the area of the shoulder 21 is shown greatly enlarged in FIG. 5A. The area of the sleeve 2 defining the interior 5, which lies between the lip 6 and the shoulder 21 and which is denoted by the reference number 25, comprises, in contrast to the depiction shown in FIG. 5, another angle of inclination to the middle axis 13 than the rest of the sleeve 2. In FIG. 5A, the area 25 of the sleeve 2 extends between lip 6 and the shoulder 21 approximately parallel to the middle axis 13. In order that the outer sleeve 17 can be placed to a small degree underneath the lip 6 when the outer sleeve 17 is slid onto the inner cup 1, the upper edge area 26 of the outer sleeve 17 is slightly compressed. The edge area 26 does not uniformly extend the conical outer sleeve 17, but rather comprises a somewhat tapering diameter. If the outer sleeve 17, as shown in FIG. 5A, is pushed slightly with its upper edge into the lip 6, the cup 1 obtains particularly good outward appearance, as the upper edge of the outer sleeve 17 is no longer visible. If the outer sleeve 17 is pushed further into the lip 6 in an embodiment not shown, the wedging of the outer sleeve 17 effects a fixing of the outer sleeve 17 by means of the material of the lip 6. For certain applications, the wedging of the outer sleeve 17 in the lip 6 can be sufficient to provide the only attachment of the outer sleeve 17.

The bead 8 of the first holding means 7 in the case of the cups is adapted to the dimension Y of the second means 9 for holding another cup 1' of the same type. When the dimensions X and Y of the cups in the FIGS. 4 and 5 comprising the various outer sleeves 17 are identical, all these various cups 1 can be stacked together in any combination without wedging, as all the outer sleeves 17 lie within the space 16 between the parallel 15 and the sleeve 2 defining the interior 5. In order to vary the optical and haptic appearance of the cup 1, the outer side 22 of the outer sleeve 17 can comprise various patterns and textures. The outer side 22 can for example be corrugated, fluted, embossed or comprise a foamed coating. It can also be provided that the outer sleeve 17 has a fluted design, and also to provide additionally the outer side 22 with a smooth cover of the fluted structure in the form of a further sleeve, in order to improve the insulating properties of the cup 1.

In particular the embodiment of the outer sleeve 17 comprising an upper curled part 19, or an attachment of the outer sleeve 17 in the area of the shoulder 21 of the sleeve 2, has the advantage in that in an area closely below the lip 6, already a very wide hollow space 18 occurs between the sleeve 2 and the outer sleeve 17, which provides a very high insulating effect. The curled part 19 or the shoulder 21 ensure, even without additional means, for example foam coatings or corrugated paperboard layers within the hollow space 18, that the distance between the sleeve 2 and the outer sleeve 17 does not decrease even under pressure, for example from a hand gripping the cup 1, and that the insulation effect is not lost.

Figure 6:
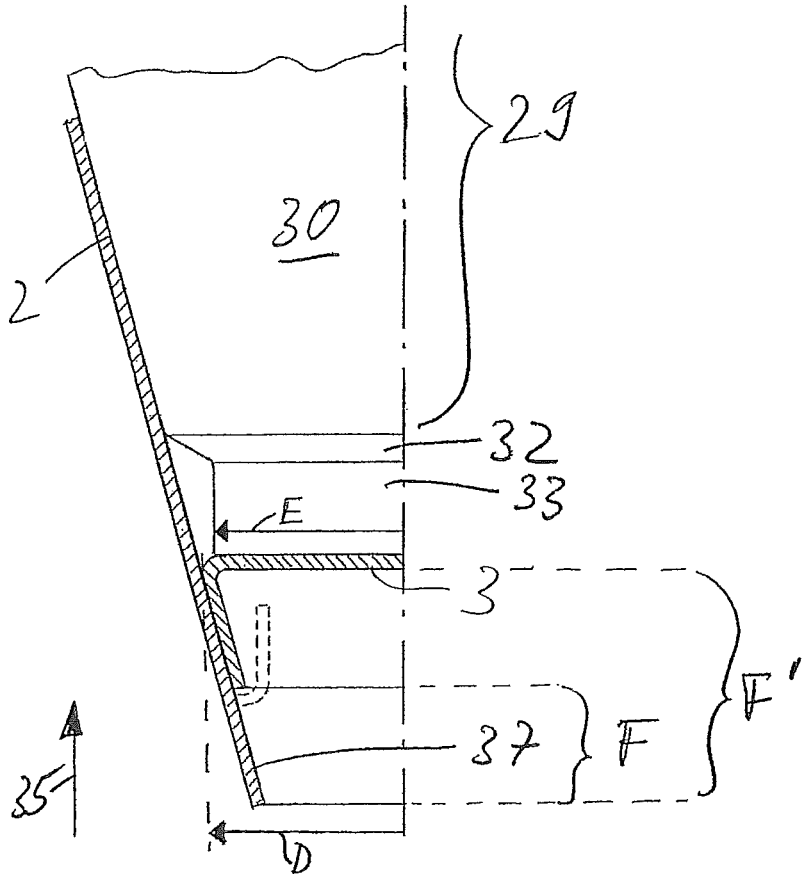
FIG. 6 is a longitudinal section of a cup in the area of the bottom skirt when the sleeve is folded inwards and when the means for holding another cup is formed.
Figure 6:
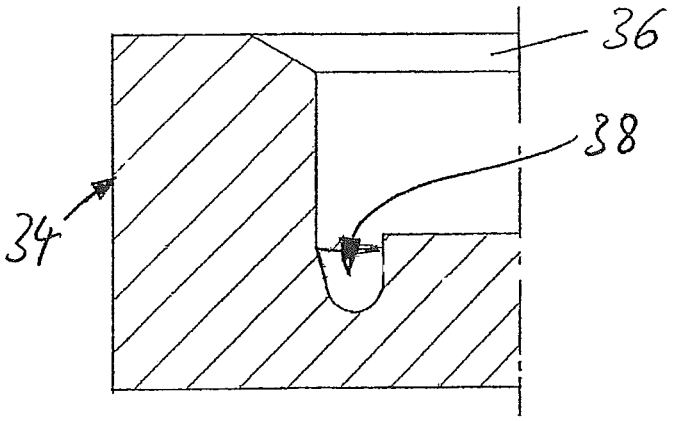

In the production of a cup according to FIG. 1, a conical sleeve 2 and an approximately pot-shaped bottom are formed. As can be seen in FIG. 6, the sleeve 2 initially has the form of a conical tube and the bottom 3 has the form of a truncated cone, which tapers parallel to the sleeve 2. In the state shown in FIG. 6, the bottom 3 and the outer sleeve 2 are not yet joined to one another, but rather are inserted into one another. The outer sleeve 2 is placed hereby upon a mandrel 30, which has a truncated cone-like shape in a first area 29, to which a further truncated cone-shaped surface 32 adjoins the tapered end of the truncated cone-shaped area 29, which cone-shaped surface 32 tapers more and which is provided for the formation of the bead 8 (see FIG. 1). Joined to the surface 32 is a circular cylinder-shaped area 33, at whose free end the bottom 3 is disposed. A diameter E of this circular cylinder-shaped area 33 can be smaller than the diameter D of the bottom, for example approximately 0.5 mm smaller {see also FIG. 1). As the bottom 3 and the sleeve 2 are not yet joined together by means of sealing or gluing, the sleeve 2 can be somewhat more compressed for the formation of the bead 8 than would be possible in the case of an already sealed sleeve 2 and bottom 3. As the sleeve 2 as well as the bottom 3 consist of coated paper material, the bottom 3 can at least be compressed to a small degree. It is then possible to draw the bead 8 relatively far into the interior of the cup 1 in order to ensure reliable stacking of a number of cups.

Figure 11:
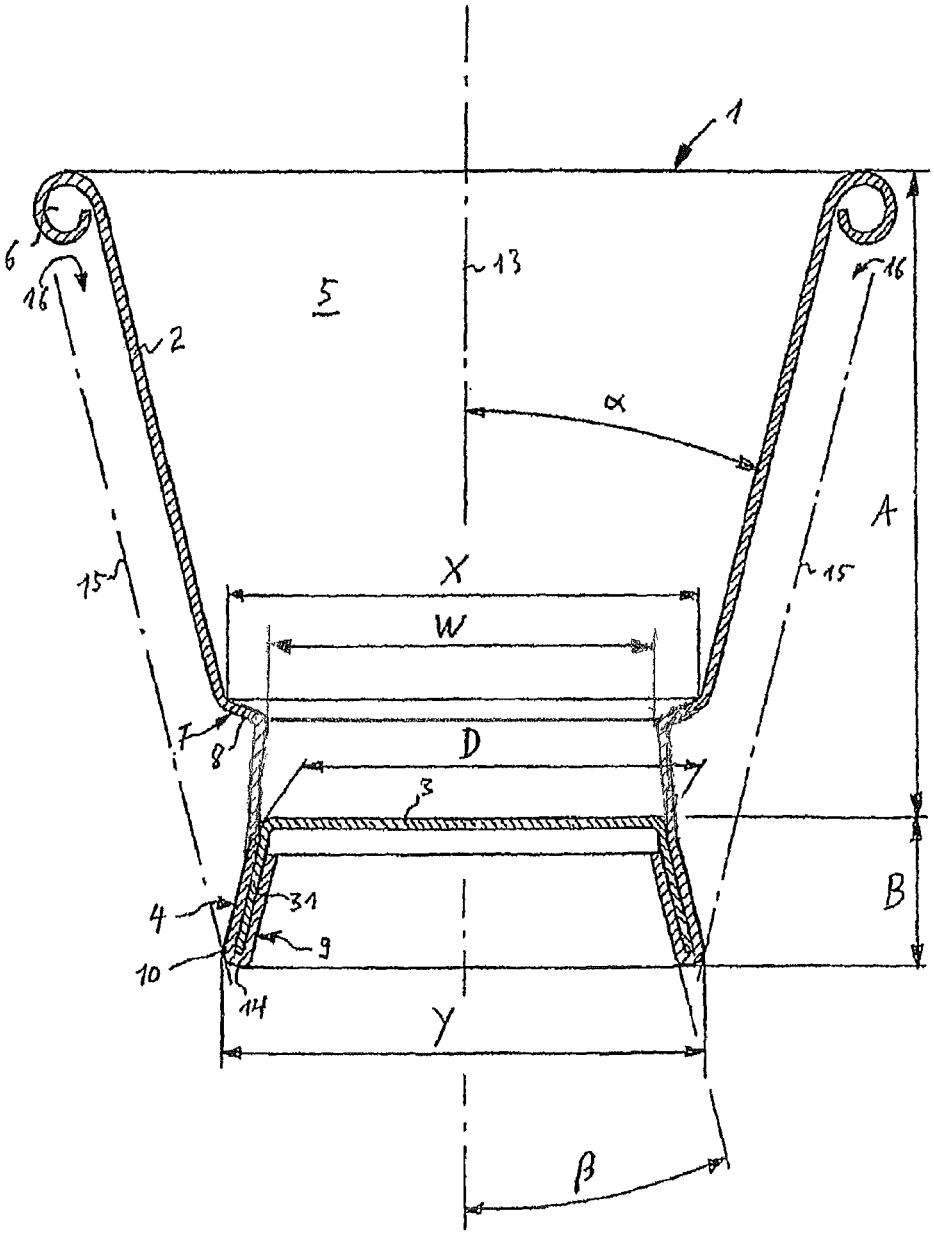
FIG. 11 shows a view similar to FIG. 1 of another embodiment of a cup according to the present invention.

Surprisingly, it is actually possible to draw the bead 8 beyond the diameter D of the bottom 3 further into the interior. A truncated cone-shaped area would adjoin the bead 8 in the direction towards the bottom 3 in the case of a finished cup 1, the conicity of said truncated cone-shaped area would be inverse to the remaining sleeve 2, which would widen again from the bead 8 to the bottom 3 (see FIG. 11).

In addition to the mandrel 30, a form tool 34 is used for the formation of the bead 8, which form tool 34 is shown in FIG. 6 and which is moved upwards in the direction of the arrow 35 towards the mandrel 30. The form tool 34 has a truncated cone-shaped surface 36, its conicity corresponding essentially to the surface 32 of the mandrel 30. The outer tube 2 is thus clamped between mandrel 30 and form tool 34 and the bead 8 is formed between the surfaces 32 and 36.

The lower end 37 of the sleeve is simultaneously folded by the form tool 34, so that it takes up the position shown in FIG. 6 by means of the broken line. For this purpose, the form tool 34 comprises a groove like area 38, which is shown only in sections in the sectional view of the form tool 34 in FIG. 6, but which extends over 360°. The simultaneous folding of the lower rim 37 of the sleeve 2 during the formation of the bead 8 facilitates the production of the cup according to the present invention.

The sleeve 2 is wound from a circular ring segment over a mandrel and then glued or sealed along a longitudinal seam. In order to facilitate the folding over of the lower edge 37 of the sleeve 2 by means of the form tool 34, the longitudinal seam of the sleeve 2 may not be glued or sealed in the area of the lower end 37. This is area is denoted with the reference letter F in the drawing in FIG. 6. When the longitudinal seam in area F is not glued or sealed, the sleeve 2 can be shaped more freely when folded and flute formation in the paper material, which is in principle difficult to form, is avoided. The area F can extend from the lower edge 37 of the sleeve 2 to the bottom edge of the bottom 3, as denoted in FIG. 6 also with the reference F'. The length F and F' is thus variable and can be altered.

Subsequent to the forming of the bead 8 and the folding of the lower end 37 of the sleeve 2, the inner cup 1 is completed in that the bottom 3 with the sleeve 2 is joined to the bottom skirt 4. This is done with the aid of an outer ring and an inner tool, whereby the widening of the bottom skirt 4 and the joining of the bottom 3 with the sleeve 2 is carried out simultaneously, so that the bottom skirt 4 in its form widening in the direction towards the lower edge 14 arises, as shown in FIG. 1. This is described below with the aid of FIG. 8.

Figure 7:
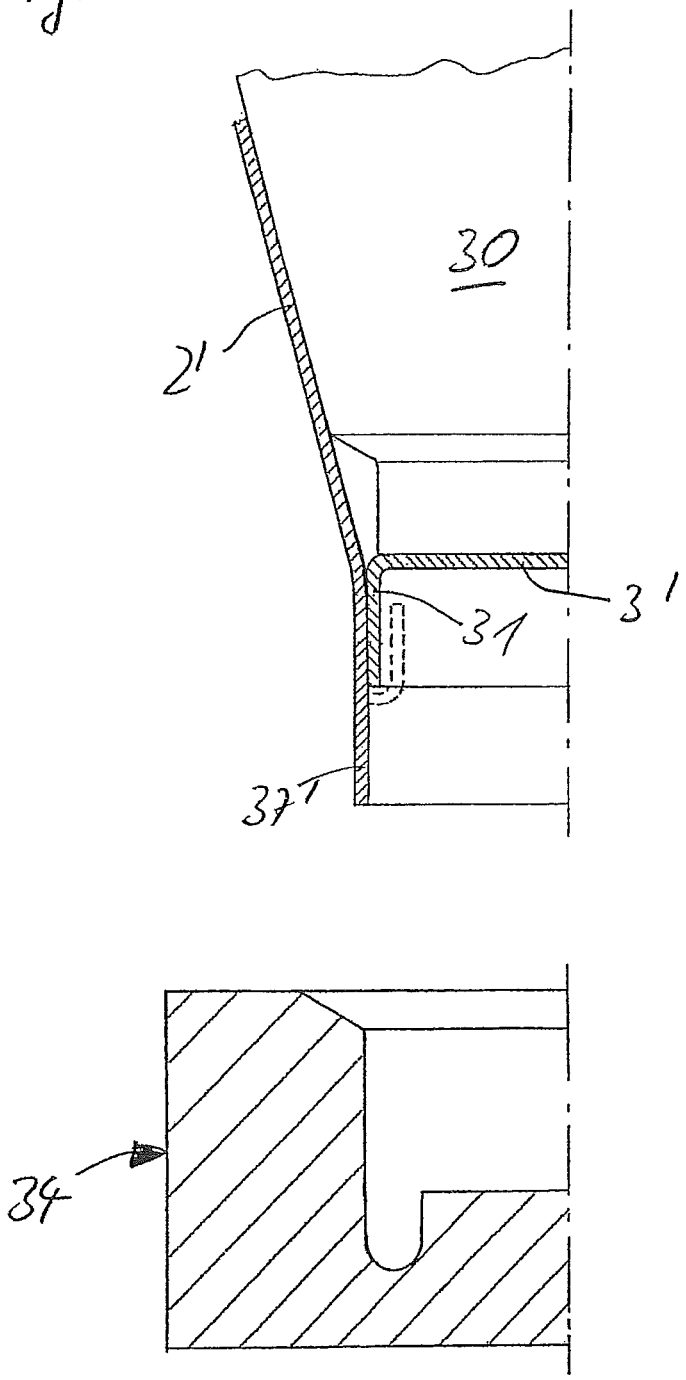
FIG. 7 is a view of a variation of FIG. 6.
Figure 8:
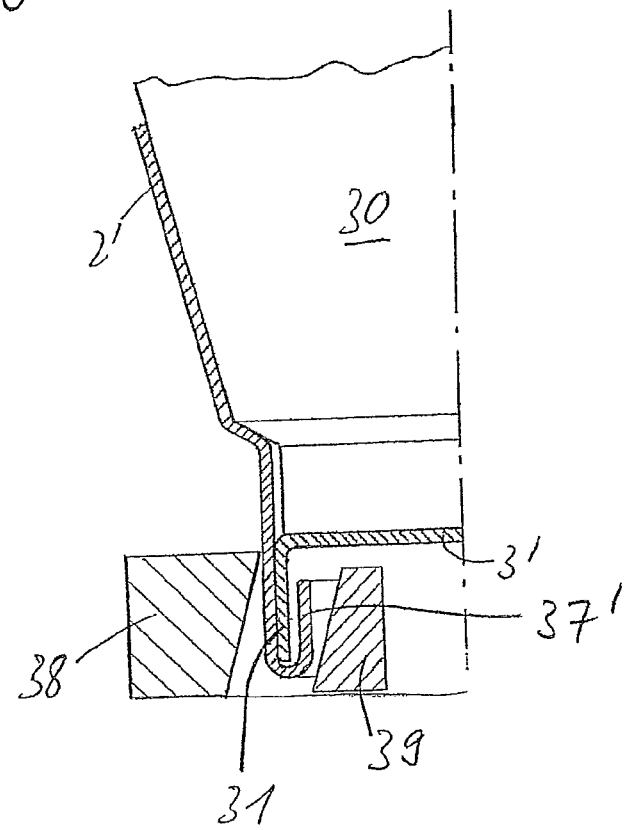
FIG. 8 is a longitudinal section of the bottom skirt of a cup according to the present invention with an inner tool and an outer tool for pressing the bottom skirt, FIGS. 9 and 10 partially show an outer sleeve of the cup as shown in FIG. 5 in various stages of manufacture.

The drawing in FIG. 7 shows a further embodiment of the present invention, whereby in contrast to the embodiment in FIG. 6 the sleeve 2' has initially a conical form which then becomes cylindrical at the horizontal bottom 3'. Consequently in this embodiment the bottom 3' has a reverse pot form with a circumferential cylindrical wall 31. The shape of the mandrel 30 and the form tool 34 are identical to the designs disclosed above according to FIG. 6. As a result of the cylindrical shape of the circumferential wall 31 of the bottom 3' and the cylindrical shape of the lower area of the sleeve 2', wrinkle formation is reduced when folding the lower edge 37' of the sleeve 2' and during the subsequent widening and forming of the bottom skirt 4.

Based on the state in FIG. 7 with the folded lower edge 37, which is denoted by broken lines, the sleeve 2' remains with the bottom 3' on the mandrel 30 and subsequent to the removal of the form tool 34, an outer ring 38 is moved into the area below the bottom 3'. An inner surface of the outer ring 38 facing the sleeve 2' is pointing outwards and comprises the angle which the bottom skirt 4 takes up in the final stage. A number of inner flanges 39 lying opposite the outer ring 38 are provided, whereby in the drawing in FIG. 8 only one inner flange 39 is shown. In the drawing in FIG. 8, the inner flanges 39 can be moved outwards in the direction towards the outer ring 38, and as a result press the folded edge 37' against the wall 31 of the bottom 3' and against the inner surface of the outer ring 38.

Either the flange 39 or the ring 38, for example, or also the inner flange 39 and the outer ring 38 can be heated, so that the then three material layers disposed on top of one another are sealed and thus form the bottom skirt 4. A surface of the inner flange 39 facing radially outwards is arranged parallel to the inward-lying surface of the outer ring 38 and also has an angle under which the bottom skirt 4 should be arranged in the final stage.

The inner flanges 39 are for example part of a mandrel and can be moved radially outwards by means of sliding of a middle part (not shown in FIG. 6). The outer ring 38 can be designed as a fixed ring or for example as a ring which can be opened in order to facilitate the sliding onto the sleeve 2'. Instead of a number of inner flanges 39, a rotating roller can for example also be supplied, which exerts a force directed radially outwards in the direction of the outer ring 38 onto the edge 37' and the wall 31, in order to form the bottom skirt 4. The cup remains on the mandrel 30 during the forming out of the bottom skirt 4.

The inner cup 1 is completed subsequent to the formation of the bottom skirt 4 and can be removed from the mandrel 30.

An outer sleeve 17 is then slid onto the finished inner cup 1, see FIG. 4, FIG. 5. This takes place in such a way that the outer sleeve 17 is taken up in a ring-like outer tool and a pilot mandrel with a suction head extends through the tapered end of the outer sleeve 17. This suction head engages an inner cup 1 from below on the bottom 3, sucks it up and pulls said inner cup 1 into the tapering outer sleeve 17 until it reaches the state shown in FIGS. 4 and 5.

Figure 9:
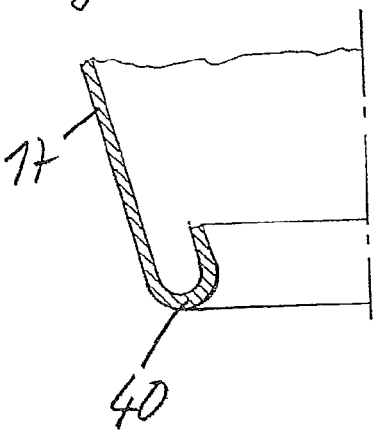
Figure 10:
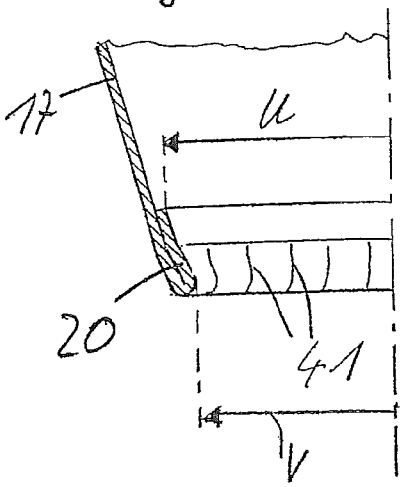

For the production of the outer sleeve 22, said outer sleeve 22 is firstly wound from a circular, ring segment-shaped blank onto a mandrel and bound to a truncated cone shaped tube. In the area of the lower tapering end, a rolled part 40 is formed as shown in FIG. 9. For the production of the cup shown in FIG. 5, the rolled part is then pressed flat until the form of rolled part shown in FIG. 10 is achieved. It can be seen that the lower edge of the outer sleeve 17, which is formed by the rolled part 20, is slightly drawn in and therefore comprises a greater conicity at the lower end, as disclosed above. In the drawing in FIG. 10, a knurl or a ribbing is indicated on the inner side of the rolled part 20. A knurl or a ribbing 41 on the inner side of the rolled part 20 can be provided in order to achieve a higher degree of elasticity when sliding the outer sleeve 17 onto the inner cup 1.

As disclosed above in FIG. 5, an inner diameter V of the rolled part 20 is smaller than the outer diameter Y, see FIG. 5 of the bottom skirt 4. When the outer sleeve 17 is slid on, the end of the outer sleeve 17 with the rolled part 20 must be widened somewhat, in order that it can be slide over the bottom skirt 4. This widening process is facilitated by the knurling or ribbing 41. Furthermore, the longitudinal seam of the outer sleeve 17 in the area of the rolled part 20 may not be glued or sealed. This facilitates a certain expansion of the outer sleeve 17 in the area of the curled part 20, so that the outer sleeve 17 can be slid over the bottom skirt and subsequently contracts again, so that the rolled part 20 lies on the outer side of the bottom skirt 4 in the position shown in FIG. 5.

It can be further established that a diameter U at the upper end of the curled part 20 is larger than the outer diameter Y of the bottom skirt 4. This can be seen also in FIG. 5. As the inner diameter of the outer sleeve 17 is therefore larger at the upper edge of the rolled part 20 than the outer diameter Y, this upper edge of the curled part 20 cannot get caught on the bottom skirt 4 when being slid onto said bottom skirt 4. Instead the bottom skirt 4 runs up the slant, which is formed by the inner side of the rolled part 20 and when the outer sleeve 17 is slid further on, the outer sleeve is widened, slides over the area with the largest diameter Y of the bottom skirt 4 and takes up the position shown in FIG. 5. The inner sleeve 17 is visibly held on the inner cup 1 by means of internal stress, as in order to remove the outer sleeve 17, the outer sleeve 17 must be drawn again over the conically widening bottom skirt 4.

It should be expressly stated at this point that the various embodiments of the outer sleeve 17 and other shaping means of the cup 1 such as the bead 8 or the shoulder 21 can be combined optionally as required, and are not restricted to the shown variations. In addition it should be noted that the drawings are not drawn to scale. For the purposes of clarity, the dimensions of the widening 10 and the angle of inclination of the bottom skirt 4 are shown larger than to scale.

We claim:

1. A cup made of a paper material and having a fillable interior formed by a sleeve and a bottom, whereby the bottom is attached with a bottom skirt in an essentially liquid-tight way to the sleeve at a lower end of the interior, wherein the sleeve and/or the bottom in the area of the bottom skirt and/or the bottom skirt itself comprise an outwardly projecting widening, and a lower edge of the widening forms a standing surface for the cup, the bottom skirt comprising a second holding element formed by the widening, the sleeve comprising a first holding element being arranged to act with a second holding element on a similar cup when said cups are stacked, wherein the dimensions of the second holding element are adapted to the dimensions of the first holding element and the first holding element is a rib or a bead provided along a circumference of the sleeve, wherein an inner diameter of the first holding element is smaller than a diameter surrounding the area of the bottom contacting the interior, wherein the sleeve has a substantially frustoconical top portion and a central portion extending from the first holding element and towards the bottom skirt and having a frustoconical shape in an inverse fashion with respect to the top portion of the sleeve.

2. A cup according to claim 1, wherein the cup comprises an outer sleeve.

3. A cup according to claim 2, wherein an outer contour of the outer sleeve is located within a parallel to the sleeve, said parallel being disposed on the widening of the bottom skirt.

4. A cup according to claim 2, wherein the outer sleeve is conical and comprises in an edge area an inwardly rolled part, which rolled part comprises an area which extends essentially parallel to the outer sleeve.

5. A cup according to claim 1, wherein the widening is at a widening angle with respect to the top portion of the sleeve and the central portion is at a central portion angle with respect to the top portion of the sleeve, the widening angle and the central portion angle being different.

6. A cup according to claim 1, wherein the first holding element is at a lower end of the sleeve and the central portion is attached to the bottom skirt.

7. A cup made of a paper material and having a fillable interior formed by a sleeve and a bottom, whereby the bottom is attached with a bottom skirt in an essentially liquid-tight way to the sleeve at a lower end of the interior, wherein the sleeve and/or the bottom in the area of the bottom skirt and/or the bottom skirt itself comprise an outwardly projecting widening, and a lower edge of the widening forms a standing surface for the cup, the bottom skirt comprising a second holding element formed by the widening, the sleeve comprising a first holding element being arranged to act with a second holding element on a similar cup when said cups are stacked, wherein the dimensions of the second holding element are adapted to the dimensions of the first holding element and the first holding element is a rib or a bead provided along a circumference of the sleeve, wherein an inner diameter of the first holding element is smaller than a diameter surrounding the area of the bottom contacting the interior, wherein the sleeve comprises a top portion and a central portion extending from the first holding element, the widening is at a widening angle with respect to the top portion of the sleeve and the central portion is at a central portion angle with respect to the top portion of the sleeve, the central portion angle being constant along the entire central portion, the widening angle and the central portion angle being different.

8. The cup according to claim 7, wherein the first holding element is at a lower end of the sleeve and the central portion is attached to the bottom skirt.

* * * * *